US006984101B2

(12) United States Patent
Schiavo, Jr.

(10) Patent No.: US 6,984,101 B2
(45) Date of Patent: Jan. 10, 2006

(54) TURBINE VANE PLATE ASSEMBLY

(75) Inventor: Anthony L. Schiavo, Jr., Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 90 days.

(21) Appl. No.: 10/619,343

(22) Filed: Jul. 14, 2003

(65) Prior Publication Data

US 2005/0013686 A1 Jan. 20, 2005

(51) Int. Cl.
*F01D 9/04* (2006.01)

(52) U.S. Cl. ..... 415/115; 415/116; 416/96 R

(58) Field of Classification Search ..... 415/115, 415/116, 117, 114; 416/96 A, 96 R, 97 R, 416/95

See application file for complete search history.

(56) References Cited

U.S. PATENT DOCUMENTS 3,807,892 A 4/1974 Frei et al.
4,263,842 A 4/1981 Moore
4,283,822 A 8/1981 Muth et al.
4,288,201 A 9/1981 Wilson
4,292,008 A 9/1981 Grosjean et al.
4,992,026 A 2/1991 Ohtomo et al.
5,634,766 A 6/1997 Cunha et al.
6,099,245 A 8/2000 Bunker
6,142,730 A * 11/2000 Tomita et al. ..... 415/115
6,261,054 B1 7/2001 Bunker et al.
6,413,040 B1 7/2002 Yu et al.
6,422,810 B1 7/2002 Burdgick et al.
6,435,812 B1 8/2002 DeStefano et al.
6,454,526 B1 9/2002 Cunha et al.

* cited by examiner

*Primary Examiner*—Edward K. Look
*Assistant Examiner*—Dwayne White

(57) ABSTRACT

A turbine vane assembly includes a turbine vane having first and second shrouds with an elongated airfoil extending between. Each end of the airfoil transitions into a shroud at a respective junction. Each of the shrouds has a plurality of cooling passages, and the airfoil has a plurality of cooling passages extending between the first and second shrouds. A substantially flat inner plate and an outer plate are coupled to each of the first and second shrouds so as to form inner and outer plenums. Each inner plenum is defined between at least the junction and the substantially flat inner plate; each outer plenum is defined between at least the substantially flat inner plate and the outer plate. Each inner plenum is in fluid communication with a respective outer plenum through at least one of the cooling passages in the respective shroud.

22 Claims, 4 Drawing Sheets

TURBINE VANE PLATE ASSEMBLY

STATEMENT REGARDING FEDERALLY SPONSORED DEVELOPMENT

Development for this invention was supported in part by Contract No. DE-FC 21-95MC32267, awarded by the U.S. Department of Energy. Accordingly, the United States Government may have certain rights in this invention.

FIELD OF THE INVENTION

The invention relates in general to turbine engines and, more particularly, to a turbine vane plate assembly configured to direct the flow of a coolant through the vane and a method of assembling the same.

BACKGROUND OF THE INVENTION

Turbine engines include a plurality of stationary vane assemblies, which are exposed to extreme thermal loads. Accordingly, provisions must be made to cool the vane assemblies. Typically, vane assemblies are cooled by routing a coolant, such as steam or compressed air, through a plurality of interior passageways formed in the vane. At least a portion of the interior cooling passages can be formed by a cooperative arrangement between a vane shroud and a shroud end cap. While such end caps have been successfully used to close and direct coolant flow in a turbine vane, the design suffers from a number of disadvantages.

For example, due to the complexity of the interfacing surfaces of the shroud and the need for internal coolant paths, shroud end caps are typically cast, such as by investment casting, and/or require extensive machining. Thus, replication in a production environment is not possible. Moreover, due to the construction of the end cap, quality inspection cannot be conducted on various brazed or welded joints between the end cap and the surrounding shroud. Further, design considerations occasionally require an increase in the height of the shrouds, which results in commensurate increases in the thickness of the end cap. Consequently, structural interferences with other components are sometimes experienced during engine installation.

Thus, one object according to aspects of the present invention is to provide a turbine vane plate assembly that can be fabricated, assembled, and inspected using conventional manufacturing methods. Another object according to aspects of the present invention is to allow replication in a production environment using conventional methods. Yet another object according to aspects of the present invention is to reduce or eliminate the use of thick solid cast and machined plates for turbine vane end caps, and preferably to use standard gauge plates. A further object according to aspects of the present invention is to permit quality inspection at each layer of assembly and fabrication. Still another object according to aspects of the invention is to provide a turbine vane assembly with a plurality of plenums and passages for directing the flow of coolant throughout the vane. An additional object according to aspects of the present invention is to provide a turbine vane assembly having engine attachment structures. These and other objects according to aspects of the present invention are addressed below.

SUMMARY OF THE INVENTION

Aspects of the present invention relate to a turbine vane assembly that includes a turbine vane having first and second shrouds with an elongated airfoil extending between. Each end of the airfoil transitions into a shroud at a respective junction. Each of the shrouds has a plurality of cooling passages, and the airfoil also has a plurality of cooling passages extending between the first and second shrouds. The assembly further includes a substantially flat inner plate and an outer plate coupled to each of the first and second shrouds so as to form inner and outer plenums.

Each inner plenum is defined between at least the junction and the substantially flat inner plate; each outer plenum is defined between at least the substantially flat inner plate and the outer plate. Each inner plenum is in fluid communication with a respective outer plenum through at least one of the cooling passages in the respective shroud. The inner and outer plenums and coolant passages can direct coolant flow throughout the vane including coolant flow within the plenums generally transverse to the elongated direction of the airfoil.

The substantially flat inner plates and at least one of the outer plates can be gauge plate. At least one of the outer plates can include an outward-facing surface with one or more integral attachments. Each of the substantially flat inner plates can be coupled to a respective shroud by brazing or welding. Each of the outer plates can be coupled to a respective shroud by structural welding. Each of the first and second shrouds can have inner and outer ledge portions, which can be substantially parallel to each other. Each of the substantially flat inner plates can be coupled to a respective shroud proximate to the inner ledge portion; each of the outer plates can be coupled to a respective shroud proximate to the outer ledge portion.

The assembly can further include at least one coolant supply tube for supplying coolant to a trailing edge portion of the airfoil. The supply tube bypassingly extends through one pair of inner and outer plenums. The assembly can further include a first coolant supply duct extending between one of the outer plates and a respective substantially flat inner plate. The first duct can allow externally-supplied coolant to enter the inner plenum of one of the shrouds and to enter at least one of the cooling passageways in the airfoil. In addition, there can be a second coolant supply duct extending between the other substantially flat inner plate and the airfoil. The second duct can allow coolant entering at least one of the cooling passageways in the airfoil from the first duct to pass into the outer plenum of the other shroud.

The assembly can further include an exit duct extending between the airfoil and one of the substantially flat inner plates. One of the outer plates can include an opening that is fluidly aligned with at least a portion of the exit duct such that coolant can exit the assembly.

The inner plenum of the outer shroud can be in fluid communication with the inner plenum of the inner shroud through at least one of the cooling passages extending through the airfoil.

In other aspects, the present invention relates to a method of assembling a turbine vane including the following steps.

(a) Providing a turbine vane including an outer shroud, an inner shroud and an airfoil extending between the inner and outer shrouds. Each shroud has first and second ledge portions. The airfoil includes an inner and an outer landing surface at each of its ends, each landing surface having a plurality of openings. The shrouds and airfoil include a plurality of internal cooling passages.

(b) Securing a first end of a duct to the inner airfoil landing. The duct is fluidly aligned with one of the plurality of openings in the inner airfoil landing.

(c) Securing a first end of a channel to the outer airfoil landing. The channel is fluidly aligned with one of the plurality of opening in the outer airfoil landing.

(d) Securing a first end of a tube to the outer airfoil landing. The tube is fluidly aligned with one of the plurality of opening in the outer airfoil landing.

(e) Securing first and second substantially flat inner plates to the inner and outer shrouds.

(f) Securing a first substantially flat inner plate to the inner shroud substantially adjacent to the first ledge portion of the inner shroud. The first plate has an opening and is positioned such that the opening is fluidly aligned with a second end of the duct.

(g) Securing a second substantially flat plate to the outer shroud substantially adjacent to the first ledge portion of the outer shroud. The second plate has first, second and third openings and is positioned such that the first opening is secured in fluid alignment to a second end of the channel and such that the second end of the tube extends through the third opening.

(h) Securing a third plate to the inner shroud substantially adjacent to the second ledge portion of the inner shroud.

(i) And, securing a fourth substantially flat plate to the outer shroud substantially adjacent to the second ledge portion of the outer shroud. The fourth plate includes a plurality of openings such that a second end of the channel is secured in fluid alignment to one of the plurality of openings, and a second end of the tube is secured in fluid alignment to another of the plurality of openings.

The vane assembly provides a series of plenums and passages to direct flow of a coolant throughout the vane assembly.

Each of the securing steps can be performed by either welding or brazing. The third plate and the fourth substantially flat plate can be secured to a respective shroud by structural welding. The first ledge portion can be substantially parallel to the second ledge portion. The first, second and fourth substantially flat plates can be gauge plates; the third plate can be substantially flat on an inwardly-facing side and can provide at least one attachment on an outwardly-facing side. The method can further include substantially sealingly closing at least one core print opening in the airfoil landing.

DETAILED DESCRIPTION OF EMBODIMENTS OF THE INVENTION

Aspects of the present invention address the drawbacks associated with prior vane assembly configurations. Aspects of the present invention relate to a turbine vane plate assembly that forms a series of plenums that, in addition to a plurality of cooling passages, direct coolant flow throughout the vane. Other aspects of the present invention are directed to a method of assembling such a turbine vane.

Embodiments of the invention will be explained in the context of a turbine vane assembly, but the detailed description is intended only as exemplary. Embodiments of the invention are shown in FIGS. 1–4, but the present invention is not limited to the illustrated structure or application.

Figure 1:
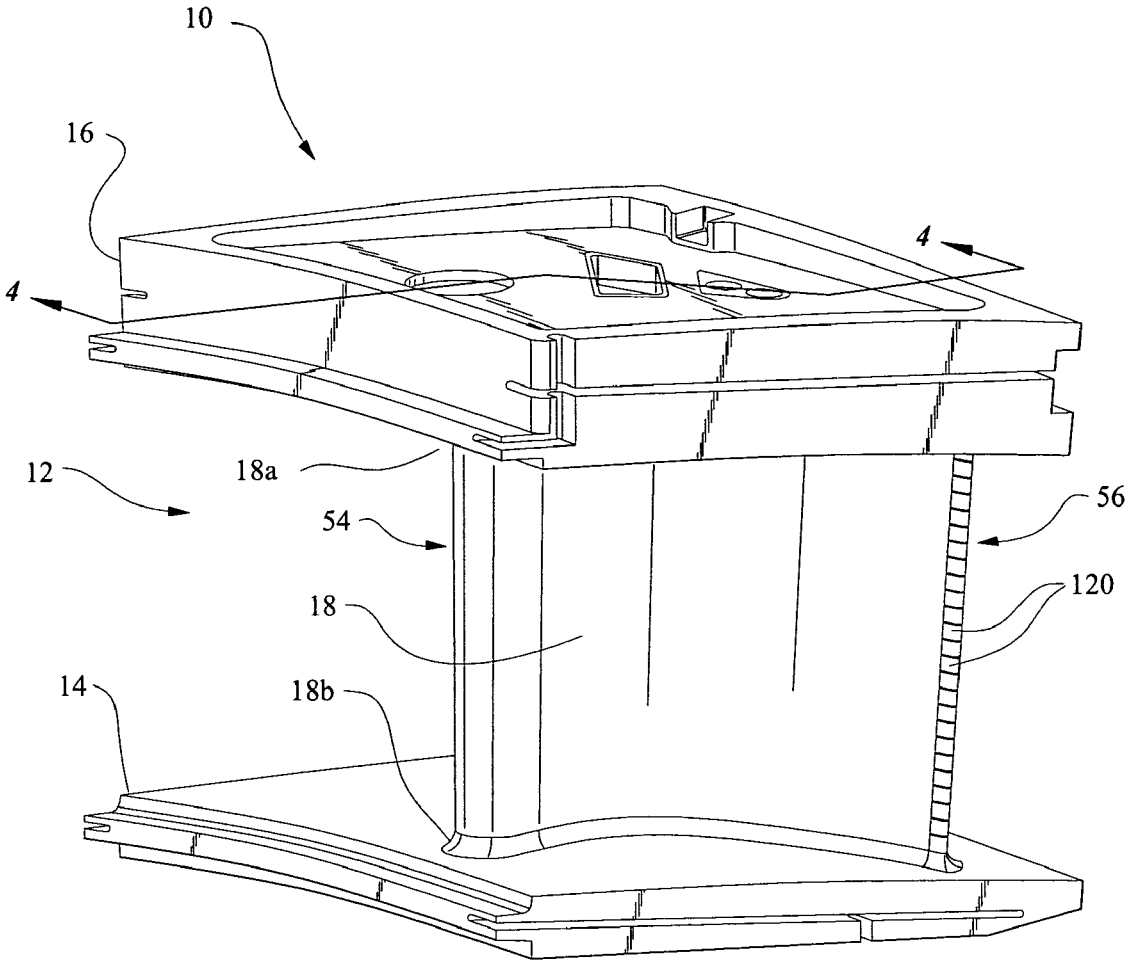
FIG. 1 is an isometric view of a turbine vane according to aspects of the present invention.

As shown in FIG. 1, aspects of the present invention relate to a turbine vane assembly 10. The assembly 10 comprises a variety of components including a vane 12. The vane generally has inner and outer shrouds 14, 16 with an elongated airfoil 18 extending between the two shrouds 14, 16. The inner and outer shrouds 14, 16 may also be referred to herein as first and second shrouds, respectively. The vane 12 can be formed by a variety of methods, but typically the vane 12 is a casting. The vane 12 can be cast as a single piece; alternatively, each shroud 14, 16 and the airfoil 18 can be cast separately and joined together in a subsequent operation. Secondary processes can be employed to form additional features such as cooling passages, or they can be employed to further refine or define features that were only roughly cast in any of these subcomponents including, for example, one or more ledge portions in a shroud.

Regardless of how the vane 12 is formed, one end of the airfoil 18*a* transitions into the outer shroud 16 to form a junction 20, and the other end of the airfoil 18*b* transitions into the inner shroud 14 which also forms a junction 22. The junctions 20, 22 can have any configuration and, in one aspect, the junction can be generally planar. Further, the junction 22 at the inner end of the vane assembly 10 does not need to be identical or even similar to the junction 20 at the outer end of the vane assembly 10.

The vane casting 12 can be provided with a series of cooling passages, any of which can be formed as part of the initial casting or can be formed by secondary processes such as machining. During these secondary processes, it may be necessary to remove a portion of material from the exterior of the vane casting 12 in order to cut the desired passages. For example, the cooling passages 100, 102, 104, 106 (FIG. 4) can be formed at least in part by drilling through the sides of the shroud 16, the airfoil 18 or the junction 20. In such case, a plug 26 can be used to seal the cooling passages 100, 102, 104, 106 from the outer environment so as to form an internal cooling passage. The plug 26 can be secured to the vane casting 12 in any number of ways including, for example, by welding or brazing.

The airfoil 18 can have a plurality of cooling passageways extending between the first and second shrouds 14, 16. For example, one series of cooling passageways 108 can extend through the thickness of an outer wall of the airfoil 18. Such cooling passages 108 may be provided about the entire periphery of the airfoil 18 or may be provided in certain portions of the airfoil 18 such as substantially along the leading edge portion 54. The passages 108 can have any conformation including, for example, being generally round and comprising one or more substantially straight portions. However, the passages 108 can have any cross-section and orientation so long as the passages 108 can allow the flow a coolant.

Figure 2:
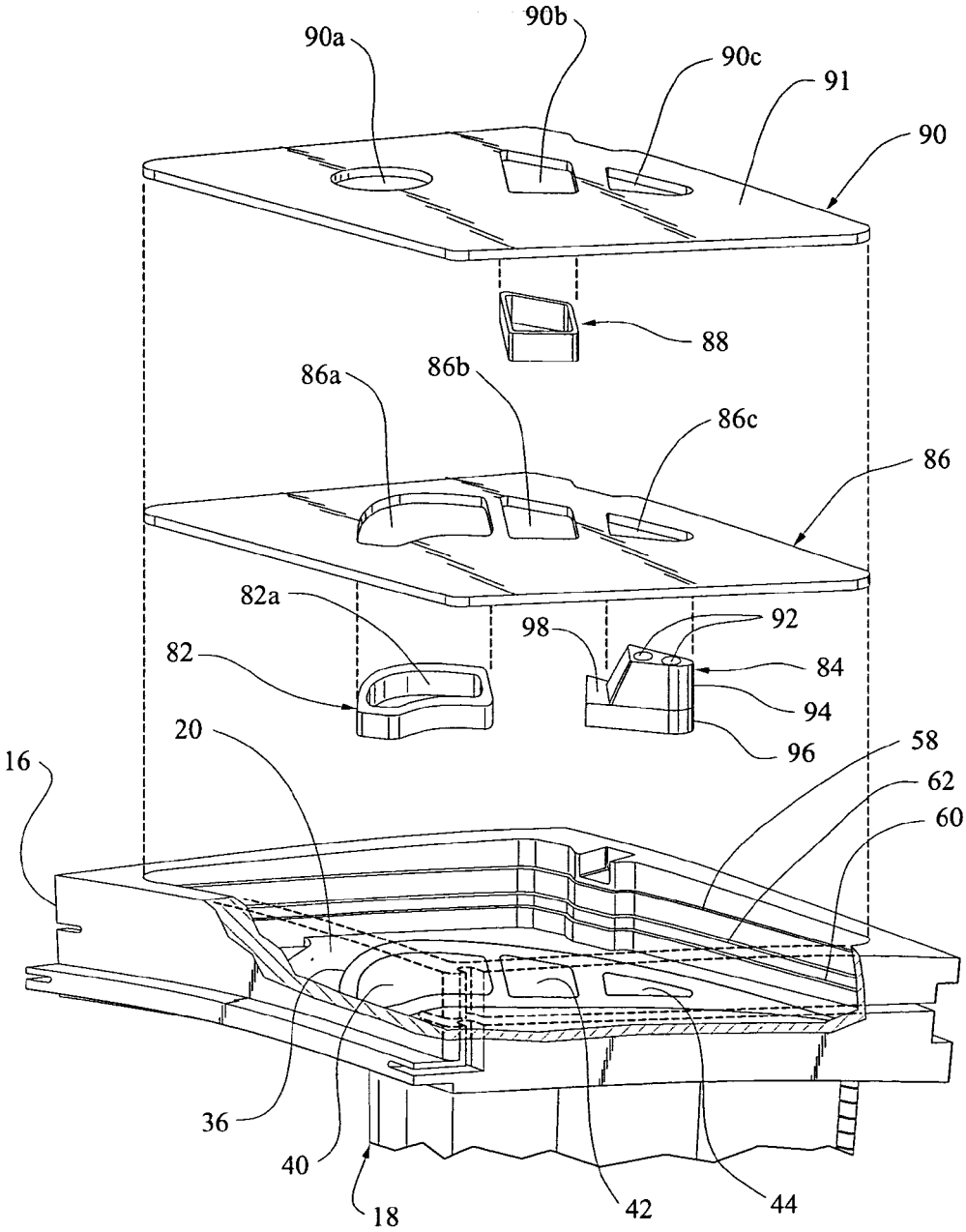
FIG. 2 is an exploded isometric view of an outer shroud of a turbine vane according to aspects of the present invention.
Figure 3:
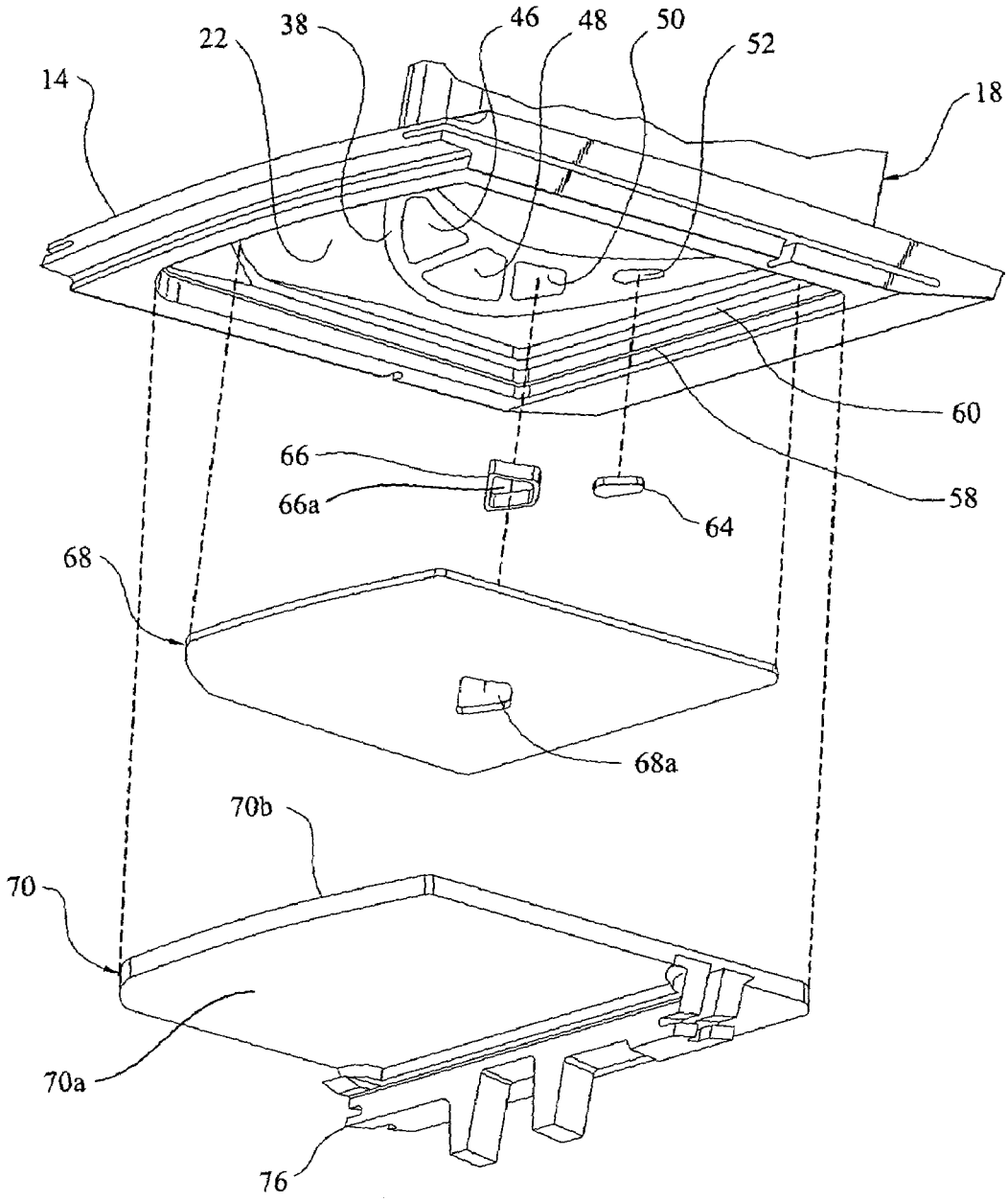
FIG. 3 is an exploded isometric view of an inner shroud of a turbine vane according to aspects of the present invention.

The airfoil 18 can further be provided with cooling passages 30, 32, 34, 35 that can span the generally hollow interior of the airfoil 18. These passages 30, 32, 34, 35 can have any configuration. For example, FIGS. 2 and 3 show the outer and inner airfoil landing surfaces 36, 38, respectively; the airfoil landing surfaces 36, 38 can comprise the extreme longitudinal ends of the airfoil 18. Each of the landing surfaces 36, 38 and/or the junctions 20, 22 can include a plurality of openings. For example, the outer airfoil 36 landing can include three openings 40, 42, 44. The inner airfoil landing 38 can include four openings 46, 48, 50, 52, possibly, but not necessarily, corresponding to openings 40, 42, 44 at the outer airfoil landing 36. For example, the openings 46, 48 at the inner airfoil landing 38 generally correspond to the single opening 40 in the outer airfoil landing 36. Each of the openings provide just a few examples of possible cross-sectional geometry for the cooling passages 30, 32, 34 extending through the airfoil 18.

Aside from the landing surfaces 36, 38, the airfoil 18 and, for that matter, the vane 12 itself can be viewed as having two basic sections—a leading edge portion 54 and a trailing edge portion 56. The leading edge 54 generally being the forward portion in relation to the oncoming flow of the working gas from a combustor. The trailing edge portion 56 generally being the rearward portion generally facing away from the oncoming combustion gases.

As mentioned above, each end 18*a*, 18*b* of the airfoil 18 can transition into a shroud 14, 16. The shrouds 14, 16 can have any of a variety of shapes. As shown in FIG. 1, for example, the shrouds 14, 16 can be generally rectangular in conformation, but the shrouds 14, 16 are not limited to such a conformation. For example, the outer shroud 16 can have a radial aspect to it; that is, the outer shroud 16 can be formed on a radius as shown in FIGS. 1 and 2. The inner and outer shrouds 14, 16 can have a generally open interior defining an inner periphery.

Figure 4:
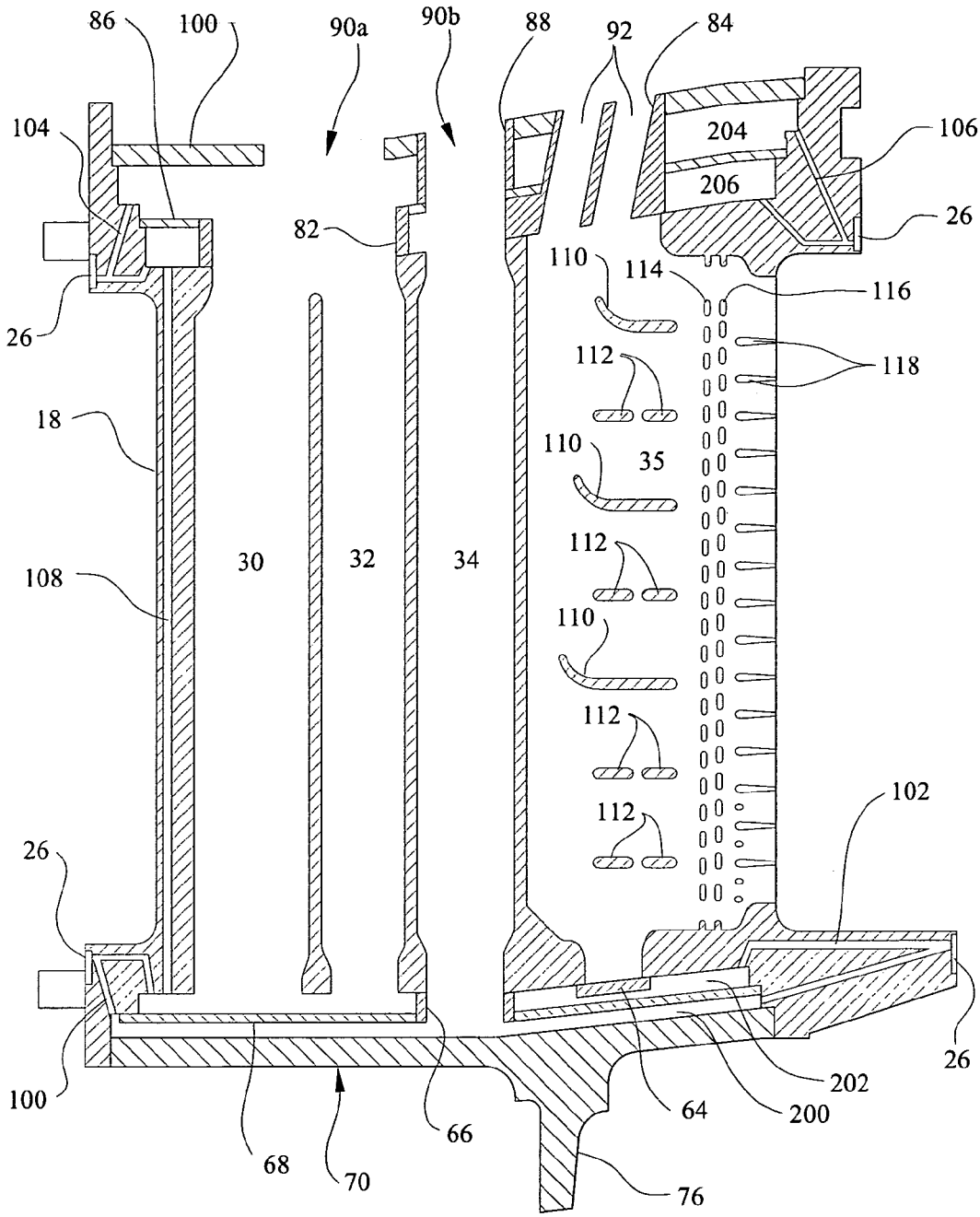
FIG. 4 is a cross-sectional view of a turbine vane according to aspects of the present invention, taken along line 4—4 of FIG. 1.

Other features may be added to the shroud 14, 16 like cooling holes as discussed previously. In addition, the shrouds 14, 16 can be provided with one or more ledge portions. As shown in FIGS. 2–4, both the inner and outer shroud 14, 16 have at least two ledge portions such as outer and inner ledge portions 58, 60, which are generally disposed at different elevations with respect to each other. Other than with respect to the shrouds 14, 16, the relative terms "outer" and "inner" are used herein to describe the spatial relationship of a component to the airfoil 18 section of the vane assembly 10. For example, the inner ledge portion 60 is generally disposed closer to the airfoil 18 than the outer ledge portion 58. Aside from being at different elevations, the inner and outer ledge portions 58, 60 can be substantially parallel to each other. The term "substantially parallel" includes true parallel and deviations therefrom.

The ledge portions 58, 60 can have any of a number of configurations. For example, the ledges 58, 60 can be substantially planar or they can be slightly curved about a radius. Preferably, the ledges 58, 60 can continuously extend about the interior periphery of the shroud 14, 16, but the ledges 58, 60 need not be continuous. For example, ledges 58, 60 can be provided on two opposing sides of the generally rectangular interior periphery of the shroud. Alternatively, the ledges 58, 60 may comprise a plurality of relatively short surfaces to form broken ledges 58, 60 about the interior periphery of the shroud 14, 16. In some embodiments, a vane assembly 10 may only have a single ledge portion or none at all. In conformation, the ledges 58, 60 can be substantially identical to or completely different from each other.

The ledges 58, 60 can be cast in the shrouds 14, 16 and/or they can be refined or added in after casting, such as by machining. The ledges 58, 60 can be a variety of widths and need not be at a constant width around the inner periphery of the shroud 14, 16. The width of the ledges 58, 60 can be the minimum dimension to provide a sufficient braze or weld joint with an abutting plate (for example, plates 68, 70, 86 and 90 discussed below). In one embodiment, the width of the ledge can be from about 2 millimeters to about 5 millimeters, and more preferably from about 2 millimeters to about 4 millimeters, and, even more preferably about 3 millimeters.

The ledge portions 58, 60 can serve as an aid during installation by providing a surface for supporting various components of the assembly 10 such as the plates (such as plates 68, 70, 86 and 90 discussed below) while those components are secured, such as by welding or brazing, to the shroud 14, 16. Moreover, the ledge portions 58, 60 can further assist in separating the cooling passages in the shroud by providing an area of overlap with the plates (68, 70, 86 and 90).

Additional ledges can be provided for other purposes as well. For example, the outer shroud 16 can include a ledge 62 for providing an exit point for coolant traveling as shown in FIG. 4. Not only may the outer shroud 16 and inner shroud 14 be different structurally, but also functionally. For example, the outer shroud 16 can be structured to be coupled to a cooling system by way of a coolant inlet port and an exhaust port. The inner shroud 14 can include various structures for attaching to other engine components. In the particular vane assembly 10 shown in FIGS. 1–4, the configuration of each of the inner and outer shrouds 14, 16 is different. Therefore, examples of individual components that can make up each shroud 14, 16 will be discussed in turn.

In the embodiment shown in FIGS. 1–4, the inner shroud 14 includes a variety of components that cooperate to provide cooling plenums and passages for cooling the inner portion of the vane 10. Examples of such components include a plug 64, a duct 66, a substantially flat inner plate 68, and an outer plate 70. Each of the components will be discussed below.

The duct 66 serves to route coolant into select regions of the vane assembly 10. As shown in FIG. 4, the duct 66 allows coolant to be supplied to an outer plenum 200 while bypassing an inner plenum 202 of the inner shroud 14. The duct 66 can have any of a variety of configurations such as circular, rectangular, polygonal, trapezoidal to name a few. Similarly, the opening 66*a* in the duct can be any of any shape as well. Preferably, the opening 66*a* generally conforms to the opening 50 in the airfoil landing 38 over which the duct 66 is placed so as to be fluidly aligned. The duct 66 can be made of any material so long as the material can withstand the turbine operating environment and can be welded or brazed to the material comprising the airfoil landing 38. As an example, one weldably compatible material can include Inconel 625.

The inner shroud 14 can further include a substantially flat inner plate 68. Preferably, the substantially flat inner plate 68 is of a standardized size such as a gauge plate. The plate 68 is contoured so as to be received in the inner shroud 14. In one embodiment, the substantially flat inner plate 68 is disposed substantially proximate or substantially adjacent to the inner ledge portion 60 of the inner shroud 14. Further, the substantially flat inner plate 68 can include one or more openings for receiving and/or fluidly communicating with other structures such as the duct 66. The substantially flat inner plate 68 can be made of numerous materials including Inconel 625, and preferably it can be made of a material that is weldably or brazably compatible with the inner shroud 14 as well as the duct 66.

The outer plate 70 can be used to close the inner shroud 14 and can further be used to provide attachments for securing the vane to other components of the turbine engine. The outer plate 70 can have any shape so long as it can be received in the inner shroud 14. The outer plate 70 can be made of a multitude of materials, but preferably it can be made of a material that can be coupled, such as by structural welding, to the inner shroud.

In one embodiment, the outer plate 70 can be a substantially flat plate without an associated attachment structure. In another embodiment, an attachment 76 is provided and is secured to the plate 70 in any of a number of manners including, for example, welding. In this case, it is preferred if the outer plate 70 is gauge plate and is substantially flat. In still another embodiment, the outer plate 70 can be a cast part with any desired features such as the attachment structure 76 formed during the casting process. In embodiments where attachment structures 76 are provided, it is preferred if the attachment structures 76 are only associated with the outwardly-facing side 70*a* of the outer plate 70, which is the side that faces away from the airfoil section 18 of the vane assembly 10. Thus, the inwardly-facing side 70*b* of the outer plate 70, which faces toward the airfoil section 18 as well as the substantially flat inner plate 68, can be substantially flat.

Another component that can be used is a plug 64. The plug 64 can be used for a variety of purposes including to sealingly close core print openings. For example, the inner airfoil landing 38 can have a plurality of openings. One opening, for example, can be a core print opening 52. The size, location and geometry of the core print opening 52 can vary based on the particular core print used. In the embodiment shown, it is preferred if the core print opening 52 is sealingly closed so as to substantially prevent leakage, but whether the plug 64 is needed can be determined by the process used to create the airfoil 18.

The plug 64 may be made of any material and, ideally, one that is weldably or brazably compatible with the airfoil landing surface 38. The plug 64 can be placed over the opening 52 so as to substantially cover the opening 52. Alternatively, the plug 64 can be placed inside the opening 52, or the plug 64 can be configured so that a portion of the plug 64 extends into the opening 52 and a portion of the plug 64 covers the opening 52. Accordingly, the plug 64 can have any shape or configuration.

As discussed later, the assemblage of the above described components can provide a series of plenums 200, 202 and passages for directing coolant into and out of the inner shroud 14. Turning now to the outer shroud 16, any number of components can be used to complete the vane assembly 10. For example, the outer shroud 16 can comprise a channel 82, a tube 84, a substantially flat inner plate 86, a duct and an outer plate. Each of these components will be discussed below.

The above discussion of the substantially flat inner plate, outer plate and duct in connection with the inner shroud 14 is of equal application to the outer shroud with exceptions noted below. The substantially flat inner plate includes three openings for fluidly communicating with the channel, the duct and the tube. Preferably, the outer plate associated with the outer shroud preferably does not have attachment structure associated with it. More preferably, the outer plate can be a substantially flat plate such as a gauge plate. Also, the outer plate of the outer shroud can have one or more openings, for example, three openings as shown in FIG. 2. The duct 88 can be identical or similar to the duct 66 that can be used in the inner shroud 14. Preferably, to reduce the number of unique parts, the ducts 66, 88 are identical.

The vane assembly 10 can further include a channel 82. The channel 82 can have any of a variety of conformations such as circular, rectangular, polygonal, trapezoidal, to name a few. Similarly, the opening 82*a* in the channel can be any shape as well. Preferably, the opening in the channel 82 generally conforms to the opening 44 in the airfoil landing 36 over or into which the channel 82 can be placed so as to be fluidly aligned. The channel 82 can be made of any material so long as the material can withstand the turbine operating environment and can be brazed or welded to the airfoil landing 36. An example of a weldably or brazably compatible material is Inconel 625.

The assembly can further comprise a tube 84. The tube 84 can have any number of holes and the holes can have any geometry. In one embodiment, shown in FIG. 2, the tube 84 has two generally circular holes 92 extending through the tube 84. The quantity and shape of the holes 92 can be dictated by engineering considerations including the geometry of the turbine component which interfaces with the tube 86 to supply coolant. The tube 86 can be made of any of a variety of materials, and it can be a material that is weldably and brazably compatible with the material comprising the airfoil landing 36.

The tube 86 can have many different conformations, and, in one possible conformation shown in FIG. 2, the tube generally has an upper half 94 and a lower half 96. The lower half 96 can be longer than the upper half 94; the upper and lower halves 94, 96 can be disposed such that the sides of the upper half 94 are in substantial continuity with the lower half 96. However, the halves 94, 96 can be disposed such that a portion of the lower half 96 extends past the overlap region between the upper and lower halves 94, 96 so as to form a shelf portion 98. Further, it is preferred if the lower half 96 of the tube 84 generally conforms to the opening 44 in the airfoil landing 36 over or into which the tube 84 can be placed so that the airfoil opening 44 and the holes 92 in the tube 84 are fluidly aligned.

Having described the individual components according to aspects of the present invention, one illustrative manner in which these components can be assembled will now be described. The following description is merely an example of a sequence in which the individual steps can occur. The described steps can be performed in almost any order and not every step described must occur.

Any core print openings or other undesired openings in the airfoil landing surface can be sealingly closed, by which applicant means that the opening is closed in any manner so as to prevent or substantially prevent a fluid from passing through. As shown in FIG. 3, the inner airfoil landing 38 can include a single core print opening 52. A plug 64 can be placed in and/or over the opening, and then the plug 64 can be secured to the airfoil landing 38 by, for example, brazing or welding. Any manner of securement is possible so long as it can sealingly close the core print opening 52.

Next, the duct 66 can be placed over one of the plurality of openings 50 in the inner airfoil landing 38 so that the duct 66 can be in fluid alignment with the opening 50 in the inner airfoil landing 38. Fluid alignment means that the two or more components in issue are situated to as to allow fluid communication between the components. The duct 66 can be positioned in several ways so as to be fluidly aligned with the opening 50. For example, the duct 66 can be positioned at least partially into the opening 50 or the duct 66 can rest on the airfoil landing 38 such that the opening 50 of the duct 66 conformingly surrounds the opening 50 in the airfoil landing 38. Regardless of how the duct 66 and opening 50 are fluidly aligned, one end of the duct 66 can be secured to the airfoil landing 38 by any of a variety of methods including, for example, brazing or welding. The duct 66 can be made of any material, preferably one that is weldably or brazably compatible with the particular material comprising the airfoil landing 38.

A substantially flat inner plate 68 can be placed into the inner shroud 14 such that it can be disposed substantially adjacent or substantially proximate to the inner ledge portion 60 of the inner shroud 14. The inner plate 68 can have an opening 68*a*, and the inner plate 68 can be positioned so that opening 68*a* can be fluidly aligned with the duct 66. Preferably, the other end of the duct 66 extends into the opening 68*a* and through the thickness of the plate 68 so that the end of the duct 66 can be disposed substantially flush with the plate 68. The end of the duct 66 can be secured to the plate 68 by, for example, brazing or welding. Similarly, the periphery of the plate 68 can be secured to the inner shroud 14, which can include at least a portion of the substantially proximate ledge 60, by any of a variety of methods including brazing or welding.

Finally, the outer plate 70 can be inserted into the inner shroud 14 so as to be substantially adjacent or substantially proximate to the outer ledge portion 58 of the inner shroud 14. The outer plate 70 can be secured to the outer shroud 14 which can include at least a portion of the substantially proximate ledge 58, in various manners, but preferably by structurally welding about the perimeter of the outer plate 70.

As a result of the above assembly, a pair of plenums 200, 202 are formed in the inner shroud 14. An inner plenum 202 can be generally defined by the space between at least the junction 22 and the substantially flat inner plate 68. An outer plenum 200 can be generally defined by the space between at least the substantially flat inner plate 68 and the outer plate 70. The inner plenum 202 of the inner shroud 14 can be in fluid communication with the outer plenum 200 of the inner shroud 14 through one or more cooling passages 100, 102 in the respective shroud. The inner and outer plenums 200, 202 and coolant passages 100, 102 of the inner shroud 14 can direct coolant flow throughout the vane 10 including coolant flow within the plenums 200, 202 generally transverse to the elongated direction of the airfoil 18.

Turning to the outer shroud side, the channel 82 can be placed over one of the plurality of openings 40 in the airfoil landing 36 such that the opening 82*a* in the channel 82 is in fluid alignment with the opening 40 in the airfoil landing 36. The channel 82 can be positioned in several ways so as to be fluidly aligned with the opening 40. For example, the channel 82 can be positioned at least partially into the opening 40, or the channel 82 can rest on the airfoil landing 36 such that the opening 82*a* of the channel 82 conformingly surrounds the opening 40 in the airfoil landing 36. Regardless of how the channel 82 and opening 40 are fluidly aligned, one end of the channel 82 can be secured to the airfoil landing 36 by any of a variety of methods including, for example, brazing or welding.

Similarly, the tube 84 can be placed proximate to one 44 of the plurality of openings in the airfoil landing 36 such that the holes 92 in the tube 84 are fluidly aligned with the opening 44 in the airfoil landing 36. For example, the tube 84 can be positioned at least partially into the opening 44 or the tube 84 can rest on the airfoil landing 36 such that the lower half 96 of the tube 84 covers the opening 44 in the airfoil landing 36. Regardless of how the tube 84 and opening 44 are fluidly aligned, the lower half of the tube 84 can be secured to the airfoil landing 36 by any of a variety of methods including, for example, brazing or welding.

Next, the substantially flat inner plate 86 can be placed in the outer shroud 16 such that it is disposed substantially adjacent or proximate to the inner ledge portion 60. In addition, the plate 86 can be provided with openings. For example, as shown in FIG. 2, the plate can include three openings 86*a*, 86*b*, 86*c*. The openings can be for a variety of purposes; for example, one opening 86*b* can be provided for coolant supply and the other two openings 86*a*, 86*c* can be provided to accommodate the tube 84 and the channel 82. The plate 86 can positioned in the outer shroud 16 such that the channel 82 extends into the opening 86*a* and sits substantially flush with the top side of the plate 86. Further, the plate 86 can be positioned such that the upper half 94 of the tube 84 extends through and beyond the respective opening 86*c* in the substantially flat inner plate 86 and such that the shelf portion 98 of the lower half 96 is disposed substantially adjacent to the underside of the inner plate 86. The tube 84 and the channel 82 can be secured to the inner plate 86 by, for example, brazing or welding. Plate 86 can be secured about its periphery to the outer shroud 16, possibly including at least a portion of inner landing 60, by various methods such as brazing or welding.

The duct 88 can placed in substantial fluid alignment with the opening 86*b* in the substantially flat inner plate 86. Once aligned, one end of the duct 88 can be secured to the substantially flat inner plate 86 by any of a variety of methods including, for example, welding or brazing.

Lastly, the outer plate 90 can be placed into the outer shroud 16 so that the outer plate 90 can be substantially proximate or substantially adjacent to the outer ledge portion 58. The outer plate 90 has openings 90*a*, 90*b*, 90*c*, so that when the plate 90 is in position, the opening 90*b* can be in substantial fluid alignment with the other end of the duct 88. In such case, the duct 88 can extend into the opening 90*b* so as to be substantially flush with the outwardly-facing side 91 of the outer plate 90. In addition, when the outer plate 90 is in position, the upper half 94 of the tube 84 can extend into the opening 90*c* so as to be substantially flush with the outwardly-facing side 91 of the outer plate 90. The other end of the duct 88 and the upper half 94 of the tube 84 can then be secured such as by brazing or welding to the outer plate 90. The outer plate 90 can be secured, preferably by structural welding, to the outer shroud 16 which can include at least a portion of the outer ledge portion 58.

As a result of the above assembly, a pair of plenums 204, 206 are formed in the outer shroud 16. An inner plenum 206 can be generally defined by the space between at least the junction 20 and the substantially flat inner plate 86. An outer plenum 204 can be generally defined by the space between at least the substantially flat inner plate 86 and the outer plate 90. The inner plenum 202 of the inner shroud 14 can be in fluid communication with the inner plenum 206 of the outer shroud 16 through at least one of the cooling passages 108 in the airfoil 18. The inner and outer plenums 204, 206 and coolant passages 104, 106 of the outer shroud 16 can direct coolant flow throughout the vane 10 including coolant flow within the plenums 204, 206 generally transverse to the elongated direction of the airfoil 18.

As is evident from the above assembly example, aspects of the present invention allow the vane to be assembled in such a way so as to allow for inspection of the welds or braze joints as the assembly is constructed. Also, the relative simplicity of the components and assembly lends itself to replication in a production environment.

Having described an assortment of components and a manner in which the components can be arranged to form a turbine vane assembly in accordance with aspects of the present invention, an example of the operation of such a vane 10 will be described below. Of course, aspects of the present invention can be employed with respect to myriad vane designs as one skilled in the art would appreciate.

One example of a vane having an internal cooling structure that is facilitated by aspects of the present invention is shown in FIG. 4. A coolant, for example steam, can be supplied to the vane assembly 10 through the duct 88. A portion of the entering coolant will be directed into the inner plenum 206 of the outer shroud 16. The coolant can flow laterally, that is, transverse to the elongated direction of the airfoil 18, through the inner plenum 206, flowing around the tube 84 and the channel 82, both of which extend through the inner plenum 204. As coolant flows toward the side walls of the plenum 206, the coolant can, in some areas, flow through the various cooling passages in the airfoil 18, the shroud 16 and/or the junction 20. For example, coolant can enter the passages 104, 106, of which there can be several of these passages disposed about the periphery of the inner plenum 206 of the outer shroud 16. Coolant that flows into the passages 104, 106 can be routed into the outer plenum 204 and can ultimately exhaust out of the vane 10 through the opening 90*a* in the outer plate 90. Another portion of the coolant in the inner plenum 206 of the outer shroud 16 can be directed toward the inner plenum 202 of the inner shroud 14 by way of the cooling passage 108, which can be one of a plurality of cooling passages that extend through the airfoil section 18. Thus, cooling is provided to the airfoil section 18. The coolant can flow out of the passage 108 and into the inner plenum 202 of the inner shroud 14, at which point the coolant can turn and travel through passages 30, 32. The coolant will ultimately exit the vane through the opening 90*a* in the outer plate 90.

Some coolant entering the vane 10 through the duct 88 can take a different path from the above-described cooling circuit. For example, some coolant will not turn into the inner plenum 206 of the outer shroud 16; instead, the coolant can proceed through a cooling passage 34 in the airfoil 18 and flow into the outer plenum 200 of the inner shroud 14, the duct 66 allowing the coolant to bypass the inner plenum 202 of the inner shroud 14. The coolant can then flow through the plenum 200 generally transverse to the direction of elongation of the airfoil 18. As it approaches the edges of the plenum 200, the coolant can be directed into cooling passages 100, 102 that fluidly communicate with the inner plenum 202 of the inner shroud 14. The shown cooling passages 100, 102 can actually be two of a plurality of cooling paths in the inner shroud 14, the airfoil 18 and/or the junction 22 that connect the inner and outer plenums 200, 202 of the inner shroud 14.

After exiting cooling passages 100, 102, the coolant will flow into the inner plenum 74 of the inner shroud 14 and will flow generally transverse to the elongated direction of the airfoil 18. The coolant can then exit the inner plenum 74 of the inner shroud 14 through the passages 30, 32 and ultimately exit the vane 10 through the opening 90*a* in the outer plate 90 of the outer shroud 16. While the exit path as shown in FIG. 4 includes two passages 30, 32, there can be any number of passages such as a single passage or three or more. The two passages 30, 32 in this example may be the product of considerations during the casting process rather than dictated by cooling design.

Another cooling circuit of the turbine vane assembly provides generally for the trailing edge portion 56 including chamber 35 of the vane. Any coolant can be used to cool the trailing edge portion 56, but air is preferred in the illustrated configuration. Coolant can enter through the two openings 92 in the supply tube 84, which allows coolant to bypass the outer and inner plenums 204, 206 of the outer shroud 16 and directly enter a cooling chamber 35 generally around the trailing edge 56 of the airfoil section 18. The chamber 35 is closed at the inner airfoil landing 38 by the plug 64.

As the coolant enters the chamber 35, it can interact with various structures provided in the chamber 35. For example, a plurality of curved structures 110 are provided to guide coolant flow while the generally planar structures 112 assist in straightening the flow. Next, the coolant can encounter dual columns of oblong structures 114, 116. The first column of oblong structures 114 is designed to restrict coolant flow; the second column 116 can be designed to effectuate impingement cooling of the airfoil 18. Beyond the dual columns 114, 116, the coolant can be guided by a plurality of structures 118 to exit the airfoil at its trailing edge 56 through a plurality of generally square window-like openings 120 (FIG. 1) in a process known as "pressure side ejection."

The above described vane is an example of an "open loop" system, which is characterized by providing one or more openings along the trailing edge of the vane to allow the coolant to exit the vane and join the working gas. Such a system can be disadvantageous, however, because it can reduce the usable energy of the working gas.

In contrast, a "closed loop" system allows a coolant to flow through the vane, cooling the vane and absorbing heat, and returning the coolant to be used elsewhere. For example, when the coolant is steam, cool steam is supplied to the vane assemblies and the heated steam may be directed to a steam turbine assembly which is coupled to the closed loop. One example of a closed loop system is disclosed in U.S. Pat. No. 6,454,526 ("the '526 patent"). Aspects of the present invention can be applied to the closed loop system disclosed in the '526 patent. For example, one skilled in the art would appreciate that outer end cap 10 and inner end cap 50 of the '526 patent can be replaced in accordance with a plate assembly according to aspects of the present invention including, for example, at least a substantially flat inner plate and an outer plate.

It will of course be understood that the invention is not limited to the specific details described herein, which are given by way of example only, and that various modifications and alterations are possible within the scope of the invention as defined in the following claims.

What is claimed is:

1. A turbine vane assembly comprising:

a turbine vane having first and second shrouds with an elongated airfoil extending between, each end of the airfoil transitioning into a shroud at a respective junction, each of the shrouds having a plurality of cooling passages, the airfoil having a plurality of cooling passages extending between the first and second shrouds; and a substantially flat inner plate and an outer plate coupled to each of the first and second shrouds so as to form inner and outer plenums, each inner plenum defined between at least the junction and the substantially flat inner plate, the outer plenum defined between at least the substantially flat inner plate and the outer plate, wherein each inner plenum is in fluid communication with a respective outer plenum through at least one of the cooling passages in the respective shroud and wherein at least one of the shroud cooling passages is disposed with an exterior of said respective shroud, whereby inner and outer plenums and coolant passages direct coolant flow throughout the vane including coolant flow within the plenums generally transverse to the elongated direction of the airfoil.

2. The assembly of claim 1 wherein each of the substantially flat inner plates is gauge plate.

3. The assembly of claim 1 wherein at least one of the outer plates is gauge plate.

4. The assembly of claim 1 wherein an outwardly-facing surface of at least one of the outerplates includes at least one integral attachment.

5. The assembly of claim 1 wherein each of the substantially flat inner plates is coupled to a respective shroud by brazing or welding.

6. The assembly of claim 1 wherein each of the outer plates is coupled to a respective shroud by structural welding.

7. The assembly of claim 1 wherein each of the first and second shrouds has inner and outer ledge portions.

8. The assembly of claim 7 wherein the inner and outer ledge portions are substantially parallel.

9. The assembly of claim 7 wherein each of the substantially flat inner plates is coupled to a respective shroud proximate to the inner ledge portion, and wherein each of the outer plates is coupled to a respective shroud proximate to the outer ledge portion.

10. The assembly of claim 1 further comprising at least one coolant supply tube for supplying coolant to a trailing edge portion of the airfoil, wherein the supply tube bypassingly extends through one pair of inner and outer plenums.

11. The assembly of claim 1 further including:

a first coolant supply duct extending between one of the outer plates and a respective substantially flat inner plate, the first duct allowing externally-supplied coolant to enter the inner plenum of one of the shrouds and at least one of the cooling passageway in the airfoil; and a second coolant supply duct extending between the other substantially flat inner plate and the airfoil, the second duct allowing coolant entering the at least one of the cooling passageway in the airfoil from the first duct to pass into the outer plenum of the other shroud.

12. The assembly of claim 1 further including:

an exit channel extending between the airfoil and one of the substantially flat inner plates; and one of the outer plates includes an opening, wherein the opening in the outer plate being fluidly aligned with at least a portion of the exit channel such that coolant can exit the assembly.

13. The assembly of claim 1 wherein the inner plenum of the outer shroud is in fluid communication with the inner plenum of the inner shroud through at least one of the cooling passages extending through the airfoil.

14. A method of assembling a turbine vane comprising the steps of:

providing a turbine vane including an outer shroud, an inner shroud and an airfoil extending between the inner and outer shrouds, each shroud having first and second ledge portions, the airfoil including an inner and an outer landing surface at each of its ends, each landing surface having a plurality of openings, wherein the shrouds and airfoil include a plurality of internal cooling passages;

securing a first end of a duct to the inner airfoil landing, the duct being fluidly aligned with one of the plurality of openings in the inner airfoil landing;

securing a first end of a channel to the outer airfoil landing, the channel being fluidly aligned with one of the plurality of opening in the outer airfoil landing;

securing a first end of a tube to the outer airfoil landing, the tube being fluidly aligned with one of the plurality of opening in the outer airfoil landing;

securing first and second substantially flat inner plates to the inner and outer shrouds; securing a first substantially flat inner plate having an opening to the inner shroud substantially adjacent to the first ledge portion of the inner shroud, the first plate being positioned such that the opening is secured in fluid alignment to a second end of the duct;

securing a second substantially flat plate to the outer shroud substantially adjacent to the first ledge portion of the outer shroud, the second plate having first, second and third openings and being positioned such that the first opening is secured in fluid alignment to a second end of the channel and such that the second end of the tube extends through the third opening;

securing a third plate to the inner shroud substantially adjacent to the second ledge portion of the inner shroud; and securing a fourth substantially flat plate to the outer shroud substantially adjacent to the second ledge portion of the outer shroud, the fourth plate including a plurality of openings wherein a second end of the channel is secured in fluid alignment to one of the plurality of openings and a second end of the tube is secured in fluid alignment to another of the plurality of openings, whereby the vane assembly provides a series of plenums and passages to direct flow of a coolant throughout the vane assembly.

15. The method of claim 14 wherein each of the securing steps is performed by one of welding or brazing.

16. The method of claim 14 wherein the third plate and the fourth substantially flat plate are secured to a respective shroud by structural welding.

17. The method of claim 14 wherein the first ledge portion is substantially parallel to the second ledge portion.

18. The method of claim 14 wherein the first, second and fourth substantially flat plates are gauge plates.

19. The method of claim 14 wherein the third plate is substantially flat on an inwardly-facing side and includes at least one attachment on an outwardly-facing side.

20. The method of claim 14 further including the step of:

substantially sealingly closing at least one core print opening in the airfoil landing.

21. A turbine vane assembly comprising:

a turbine vane having first and second shrouds with an elongated airfoil extending between, each end of the airfoil transitioning into a shroud at a respective junction, each of the shrouds having a plurality of cooling passages, the airfoil having a plurality of cooling passages extending between the first and second shrouds; and a substantially flat inner plate and an outer plate coupled to each of the first and second shrouds so as to form inner and outer plenums, each inner plenum defined between at least the junction and the substantially flat inner plate, the outer plenum defined between at least the substantially flat inner plate and the outer plate, wherein each inner plenum is in fluid communication with a respective outer plenum through at least one of the cooling passages in the respective shroud and wherein at least one of the outer plates is gauge plate, whereby inner and outer plenums and coolant passages direct coolant flow throughout the vane including coolant flow within the plenums generally transverse to the elongated direction of the airfoil.

22. A turbine vane assembly comprising:

a turbine vane having first and second shrouds with an elongated airfoil extending between, each end of the airfoil transitioning into a shroud at a respective junction, each of the shrouds having a plurality of cooling passages, the airfoil having a plurality of cooling passages extending between the first and second shrouds; and a substantially flat inner plate and an outer plate coupled to each of the first and second shrouds so as to form inner and outer plenums, each inner plenum defined between at least the junction and the substantially flat inner plate, the outer plenum defined between at least the substantially flat inner plate and the outer plate, wherein each inner plenum is in fluid communication with a respective outer plenum through at least one of the cooling passages in the respective shroud and wherein each of the first and second shrouds has inner and outer ledge portions, whereby inner and outer plenums and coolant passages direct coolant flow throughout the vane including coolant flow within the plenums generally transverse to the elongated direction of the airfoil.

* * * * *